US006298779B1

(12) United States Patent
Gotanda et al.

(10) Patent No.: US 6,298,779 B1
(45) Date of Patent: Oct. 9, 2001

(54) ROTARY PRESS

(75) Inventors: Takashi Gotanda, Yamato; Takafumi Kawaguchi, Zama, both of (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/435,345

(22) Filed: Nov. 8, 1999

(30) Foreign Application Priority Data

Nov. 11, 1998 (JP) ..... 10-320619

(51) Int. Cl.[7] ..... B41F 31/00; B41L 23/00
(52) U.S. Cl. ..... 101/350.1; 101/148
(58) Field of Search ..... 101/147, 148, 101/350.1, 350.2, 363, 364, 365, 366

(56) References Cited

U.S. PATENT DOCUMENTS 3,552,312 * 1/1971 Schinke et al. ..... 101/352
5,136,940 * 8/1992 Olek et al. ..... 101/148
5,218,903 * 6/1993 MacConnell et al. ..... 101/148

* cited by examiner

*Primary Examiner*—Ren Yan
(74) *Attorney, Agent, or Firm*—Pillsbury Winthrop LLP

(57) ABSTRACT

In a rotary press, ink transferring rollers and water transferring rollers provided in printing units are capable of separately and speed-variably controlled respectively by ink transferring rollers driving unit and water transferring driving unit independently of drive of print cylinder of the printing unit. Accordingly, spoilage can be avoided and printing failure such as doubling and hickey can be prevented, thereby improving print quality.

6 Claims, 7 Drawing Sheets

ROTARY PRESS

BACKGROUND OF THE INVENTION

1. Field of the Invention

The present invention relates to a rotary press having a printing unit for printing picture on a web fed by a paper feeder.

2. Description of Related Art

As shown in FIG. 4, a general offset rotary press 1 has a paper feeder 2 for feeding consecutive web W, a delivery device 3 for delivering the web W from the paper feeder 2 to downstream (in right direction in the figure), a printer 5 including a plurality of printing unit 5A to 5D having blanket cylinder 4 etc. thereinside for printing picture on the web W delivered by the delivery device 3, a drier 6 for drying ink distributed on the printed web W, a cooler 7 for cooling the web W sent from the drier 6, and a folding machine 8 for cutting and folding the web W.

As shown in FIG. 5, the respective printing units 5A to 5D (represented by the printing unit 5A hereinafter) of the rotary press 1 include a print cylinder 50 having printing form, the blanket cylinder 4 for printing on the web W by being transferred with ink from the print cylinder 50, a ink furnishing unit 51 for feeding the ink to the print cylinder 50, and a water feeder 61 for feeding water to the print cylinder 50.

Incidentally, the print cylinder 50, the ink finishing unit 51 and the water feeder 61 are provided on the printing unit 5A to upper and lower side of the web W for double-side printing of the web W.

The ink furnishing unit 51 includes an ink fountain 52 for storing the ink, an ink fountain roller 53 for drawing the ink out from the ink fountain 52, an ink key (not shown) for adjusting ink draw amount by the ink fountain roller 53, and an ink ductor 55 for transferring the ink from the ink fountain roller 53 to downstream ink transferring rollers 54.

The ink transferring rollers 54 include a plurality of ink distributing roller 56, a plurality of ink smoothing roller 58 and a plurality of ink form roller 59. The ink drawn out by the ink fountain roller 53 is kneaded and leveled while passing the rollers 54 and is fed to the print cylinder 50.

The water feeder 61 includes a water fountain 62, a water fountain roller 63 for drawing water out from the water fountain 62, a dampening roller 64 for transferring the water from the water fountain roller 63, a water form roller 65 for applying the water to the print cylinder 50, and a water rider 66, the dampening roller 64, the form roller 65 and the rider 66 forming the water transferring rollers 67. The water drawn out by the water fountain roller 63 is leveled while passing the water transferring rollers 67 and is fed to the print cylinder 50.

The drive of the ink transferring rollers 54 and the water transferring rollers 67 is conventionally transmitted from a main motor to respective printing units 5A to 5D through a line shaft. The drive is transmitted to printing cylinders such as the print cylinder 50 by a bevel gear etc., wherefrom the drive is transmitted to the ink transferring rollers 54 and the water transferring rollers 67 through a clutch 70 and an idler gear 71, and further through a gear cooperative mechanism 72 as shown in a driving system of FIG. 6.

When the ink transferring rollers 54 are driven, the drive from the clutch 70 and the idler gear 71 is transmitted to a gear 73A coaxial with one of the three ink smoothing rollers 58. A gear 74 is meshed with the gear 73A and a timing pulley 75 is provided coaxially with the gear 74. When a rotation of the gear 73A is transmitted to the gear 74 and the other three gears 73, the four ink smoothing rollers 58 are rotated and the ink transferring rollers 54 such as the ink distributing roller 56 are dragged to be rotated as shown in FIG. 5.

The gear cooperative mechanism 72 is composed including the gear 73A, 73, 74 and the timing pulley 75. The ink fountain roller 53 is driven by an ink fountain roller driving motor (not shown).

When the water transferring rollers 67 are driven, the form roller 65 is rotated by meshing the clutch 70 and a water driving gear 77 coaxial with the water form roller 65 and the water rider 66 is dragged to be rotated by the rotation.

Incidentally, the water fountain roller 63 is driven by a driving motor (not shown).

However, following disadvantages occur in driving the ink transferring rollers and the water transferring rollers of the conventional rotary press.

First, since the ink transferring rollers 54 and the water transferring rollers 67 are driven by the line shaft driven by a main motor and the gear cooperative mechanism connected to the line shaft, the ink transferring rollers 54 and the water transferring rollers 67 are driven at a rate proportional to a peripheral speed of the print cylinder. In order to change the peripheral speed of the respective rollers 54 and 67, the number of teeth of the gear has to be changed or roller diameter has to be changed, which is difficult. Accordingly, doubling and hickey, which can be prevented by changing the peripheral speed, are likely to be caused, thereby preventing the print quality from being improved.

Second, since the ink transferring rollers 54 and the water transferring rollers 67 are driven by the gear cooperative mechanism connected to the line shaft, the respective rollers 54 and 67 cannot be independently driven and suspended without driving or suspending the printer body. Accordingly, an ink film is not formed on the ink transferring rollers 54 and emulsified status is not generated on the water transferring rollers 67 in advance and such process has to be conducted in initiating printing process. Therefore, extra web W is used before generating the ink film and the emulsified status, which increases paper spoilage.

Third, since the drive is transmitted and shut between; the ink transferring rollers 54 and the water transferring rollers 67; and the printer body side by switching the clutch, both rollers 54 and 67 cannot be separately driven. Accordingly, when both of the rollers 54 and 67 or either one of the rollers has to be run idle for maintenance etc., the printer body has to be actuated. In this case, since the web W sandwiched between the blanket cylinders 4 will be fed, extra portion of the web W has to be cut. Consequently, the web W has to be inserted between the blanket cylinders, which is troublesome and deteriorates efficiency of printing process since the clutch has to be set on and off to deteriorate operability.

Fourth, the peripheral speeds of the print cylinder and the water form roller preferably have a difference in order to remove the hickey as the printing failure. On the other hand, in printing on a rough paper etc., paper dust or the like may be raised when there is a peripheral speed difference and the paper dust is likely to adhere on the surface of the water form roller, thereby hindering printing with good quality. However, since the water transferring rollers 67 cannot be driven with variable speed in the conventional drive, the peripheral speed of the water rollers cannot be changed freely in accordance with the paper. Accordingly, it is difficult to print on printing papers having different paper quality (e.g. coated paper and rough paper), thereby hindering improvement of printing quality.

The above problems occur because the rollers are mechanically driven. Accordingly, an electrically controlled driving means 88 can be designed as shown in FIG. 7.

In this arrangement, when the individual member (such as first roller and ink form roller) is independently speed-proportionally-operated in proportion to a predetermined standard (spindle rotation), speed of the standard is detected by a rotational frequency detecting device 80 and spindle rotational frequency is outputted to an electric motor controller 81 by a ratio setting device 82 as a speed command defined in proportion to the first axis rotation speed. The electric motor controller 81 compares and operates the speed command from the ratio setting device 82 by a processor 85 and a speed sensor 84 for detecting speed of the motor 83. After adding or subtracting the difference, the command is outputted to a speed controller 86 and the motor 83 is driven by a command from the speed controller 86 through an amplifier 87.

In the above arrangement, however, control accuracy is difficult to be obtained because of being general-type proportional operation method, so that speed fluctuation unevenness is likely to be caused on account of touch shock of the ink fountain roller and a shock by a gap of the print cylinder, thereby being difficult to keep the peripheral speed relative to the print cylinder surface. Accordingly, water pattern and ink pattern are likely to be generated on the printing paper, thereby deteriorating print quality.

Further, in order to exclude such rotational speed unevenness, inertia on the motor side and output torque have to be made larger for enduring momentary torque fluctuation, which requires large-capacity motor, thereby obstructing reduction of size of the unit and cost.

SUMMARY OF THE INVENTION

An object of the present invention is to provide a rotary press capable of independently driving the ink transferring rollers and the water transferring rollers without unevenness of the rotation speed, thereby improving print quality and operability thereof.

The present invention is a rotary press including a printing unit for printing picture on a web fed from a paper feeder, the printing unit comprising: ink transferring rollers having a print cylinder and an ink form roller for distributing the ink drawn out from an ink fountain onto the print cylinder by an ink fountain roller; water transferring rollers including a water form roller for distributing water drawn out from a water fountain onto the print cylinder by a water fountain roller; ink transferring rollers driving unit for driving the ink transferring rollers independently of drive of the print cylinder of the printing unit; and a water transferring rollers driving unit for driving the water transferring rollers independently of drive of the print cylinder of the printing unit.

In the above arrangement, the ink transferring rollers driving unit and the water transferring rollers driving unit is preferably controlled by an electric controller. However, the respective rollers may be driven by a mechanical driving unit for driving the respective rollers by driving a gear cooperative mechanism by a motor independent of the printing unit body.

According to the present invention, since the ink transferring rollers and the water transferring rollers are separately driven independently of the print cylinder of the printing unit, no operation such as interlocking the drive by a clutch while driving the print cylinder is required, thereby improving operability. Further, since the respective rollers can be driven while suspending drive of the print cylinder, ink film can be formed on the ink transferring rollers beforehand. Accordingly, before initiating printing process, the print cylinder and the water rollers with the water form roller touched to the print cylinder can be driven to feed dampening water on a printing surface and, subsequently, the ink form roller of the ink transferring rollers having the ink film can be touched to the print cylinder to rotate, so that the emulsified status can be quickly created on the water transferring rollers. Consequently, print paper loss in initiating the printing process can be lessened to paper spoilage. Further, since the rotational speed of either one of or both of the rollers can be set at a predetermined speed in advance, printing failure such as doubling and hickey can be prevented, thereby improving print quality.

In the present invention, the rotation speeds of the ink transferring rollers and the water transferring rollers are preferably variable.

In the above arrangement, driving speeds of the ink transferring rollers driving unit and the water transferring rollers driving unit for driving the ink transferring rollers and the water transferring rollers are preferably variable.

In the above, the speed of the respective rollers may be varied by electric control using a speed-variable motor etc. or mechanical control using belt or the like.

According to the present invention, the drive of the ink transferring rollers and the water transferring rollers can be synchronized with the drive of the print cylinder of the printing unit. Accordingly, the respective rollers can be driven without rotational speed unevenness during normal printing process, thereby being capable of obtaining high print quality. Further, since the ink transferring rollers and the water transferring rollers can be driven with variable speed in accordance with paper quality of the web to be printed, printing failure such as doubling and hickey can be prevented and waterless printing can be quickly conducted as well as being capable of printing on printing papers with different paper quality (such as coated paper and rough paper), thereby improving print quality.

In the present invention, the ink transferring rollers driving unit and the water transferring rollers driving unit may respectively include a speed-variable motor for speed-variably rotating the ink transferring rollers and the water transferring rollers and a rotation controller for controlling a rotation of the speed-variable motor based on a rotational position command corresponding to rotational position of the print cylinder. The rotation controller may preferably include first arithmetic unit for comparing a detected position information by a rotational position sensor of the speed-variable motor and a position based on the rotational position command to calculate difference therebetween; a speed controller for converting a position command calculated and outputted by the first arithmetic unit to output as a speed command; a differentiator provided at an intermediary of the detected position information for differentiating the position information detected by the rotational position sensor to convert into speed; second arithmetic unit for comparing the speed command from the speed controller and the speed from the differentiator to calculate the difference therebetween; a torque controller for converting the speed command calculated and outputted by the second arithmetic unit into a torque command; and an amplifier for driving the speed-variable motor based on the torque command from the torque controller.

In the above, AC servomotor and vector inverter motor may preferably be used as the speed-variable motor.

According to the present invention, the speed obtained by the rotational position command proportionally defined relative to the rotation of the print cylinder and the speed obtained by differentiating the rotational position information of the speed-variable motor are compared and operated to be converted into torque, so that the speed-variable motor is driven by way of the amplifier. Accordingly, the speed-variable motor can be driven at the same speed as the command value without rotational unevenness. Therefore, water pattern and ink pattern caused on the print paper can be prevented so that the print quality can be improved. Further, since momentary torque fluctuation can be endured, large-capacity motor is not required, thereby reducing the size of the facility and the cost.

In the present invention, a load torque estimator provided between the differentiator and the amplifier for comparing and calculating the torque outputted by the torque controller and the torque obtained by further differentiating the speed differentiated by the differentiator by a pseudo differentiator may further be provided, and third arithmetic unit for adding the torque to the torque controller to output to the amplifier may be connected the load torque estimator.

According to the present invention, since the time-delay of the speed response loop can be prevented, the responsivity relative to the load torque can be improved, thereby restraining the speed drop as small as possible.

In the present invention, the load torque estimator may preferably include a filter for shutting frequency of exceeding a predetermined frequency outputted by comparing and calculating the torque outputted by the torque controller and the torque outputted by the pseudo differentiator.

According to the present invention, since the filter does not pass the outputted frequency exceeding the predetermined frequency, e.g. high-frequency, the speed-variable motor does not respond to each minute fluctuation to prevent vibration, thereby improving print quality.

DETAILED DESCRIPTION OF PREFERRED EMBODIMENT(S)

An embodiment of the present invention will be described below with reference to attached drawings.

Figure 1:
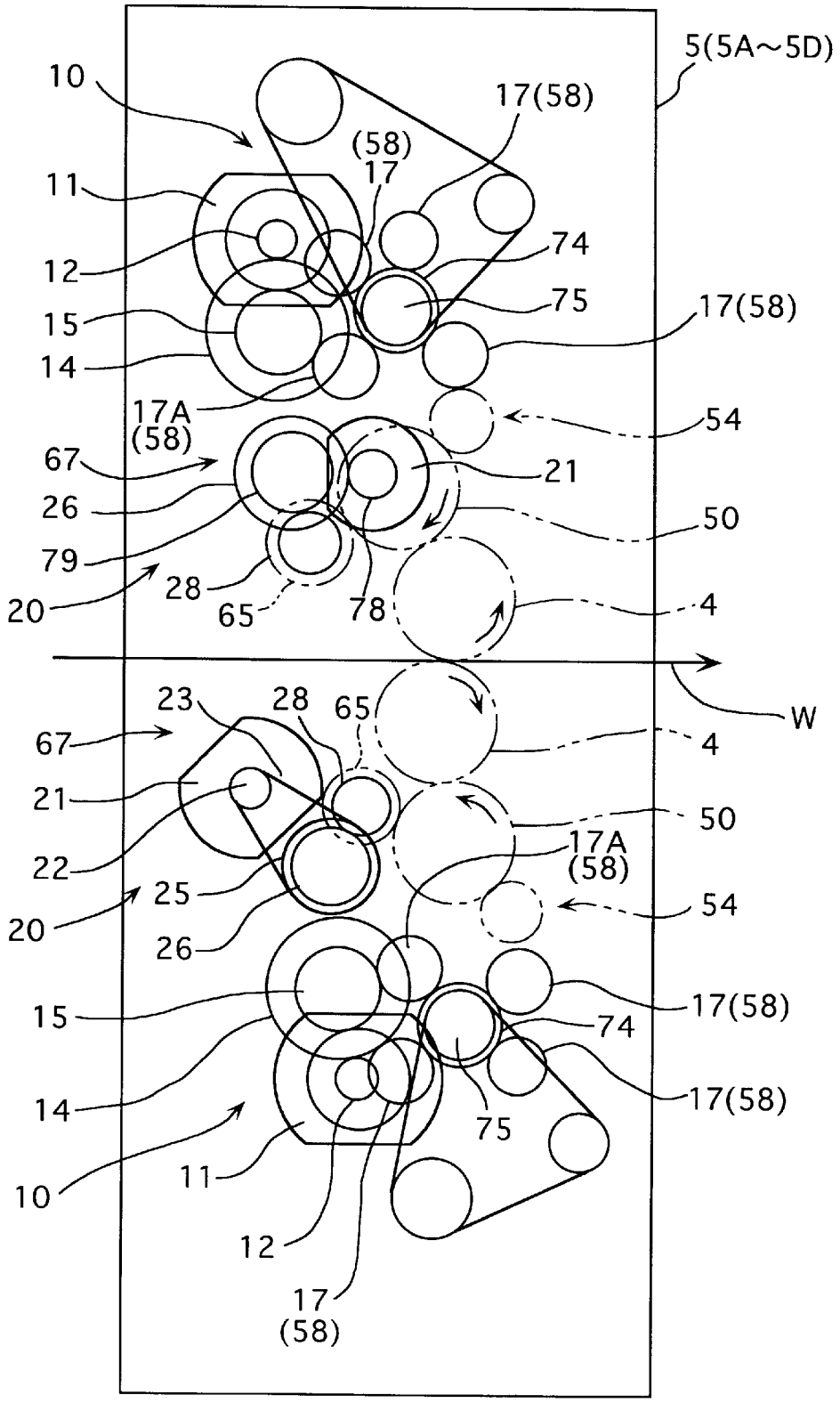
FIG. 1 is an entire view showing a driving system of ink transferring rollers and water transferring rollers according to an embodiment of the present invention.

As shown in FIG. 1, the ink transferring rollers 54 and the water transferring rollers 67 provided on the printing unit 5A according to the present embodiment are capable of independently being driven respectively by an ink transferring rollers driving unit 10 and a water transferring rollers driving unit 20.

Incidentally, the ink transferring rollers and the water transferring rollers of the present embodiment are corresponding to the ink transferring rollers 54 and the water transferring rollers 67 of the conventional printing unit 5A. The same reference numeral is attached to the same arrangement and members used as the conventional printing unit 5A to omit or simplify detailed explanation therefor.

Figure 2:
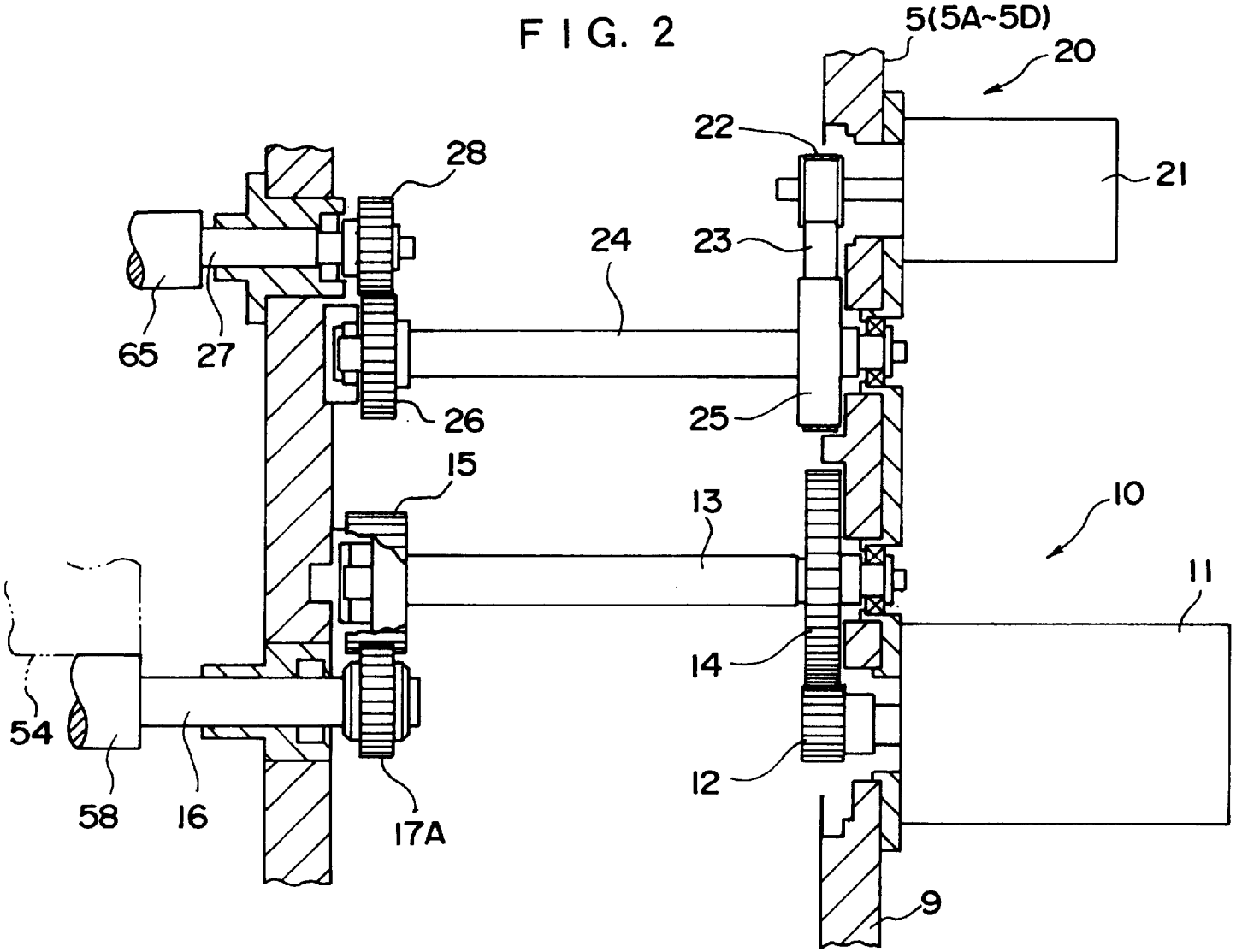
FIG. 2 is a vertical sectional view showing the driving system of the ink transferring rollers and the water transferring rollers according to the embodiment.

As shown in FIG. 2 (FIG. 2 shows only lower side of the printing unit), the ink transferring rollers driving unit 10 has an ink form roller driving motor 11 (referred to as ink motor hereinafter) as a speed-variable motor.

The ink motor 11 is attached to a frame 9 of the printing unit 5A and first spur gear 12 is attached to a spindle thereof. The first spur gear 12 is meshed with second spur gear 14 attached to an end of first connecting shaft 13. Third spur gear 15 is attached to the other end of the first connecting shaft 13 and an ink form roller driving gear 17A (the gear 17A corresponds to the gear 73A of conventional arrangement) attached to an end of second connecting shaft 16 is meshed with the third spur gear 15. The ink smoothing roller 58 is provided on the other side of the second connecting shaft 16.

Accordingly, by driving the ink motor 11, power thereof is transmitted to the gear 17A coaxial with one of the four smoothing rollers 58, wherefrom the power is transmitted to the three gears 17 through the gear 74 to rotate the four ink smoothing rollers 58, so that the ink transferring rollers 54 such as the ink distributing rollers 56 are drag-rotated by the rotation of the ink smoothing rollers 58. The ink is distributed to the print cylinder 50 from the ink fountain 52 through the ink transferring rollers 54.

As shown in FIG. 2, the water transferring rollers driving unit 20 has a water form roller driving motor (referred to water motor hereinafter) 21.

The water motor 21 is attached to the frame 9 of the printing unit 5A and first timing pulley 22 is attached to the spindle thereof. Second timing pulley 25 attached to an end of third connecting shaft 24 is connected to the first timing pulley 22 through a timing belt 23. Fourth spur gear 26 is provided on the other end of the third connecting shaft 24. A water form roller driving gear 28 attached to an end of the fourth connecting shaft 27 is meshed with the fourth spur gear 26. The water form roller 65 is provided on the other end of the fourth connecting shaft 27.

Accordingly, when the water motor 21 is driven, power thereof is transmitted to the water form roller 65 to distribute the water to the print cylinder 50.

The ink transferring rollers driving unit 10 is configured in the same manner on the lower part and the upper part of the printing unit 5A. However, the water transferring rollers driving unit 20 has a slightly different arrangement between the upper and lower parts.

Specifically, upper first spur gear 78 is attached to a spindle of the motor 21 and an upper second gear 79 is meshed with the gear 78. The gear 79 is meshed with the water fountain roller driving gear 28. Accordingly, the rollers are driven by the connection between the gears on the upper part of the printing unit 5A.

Figure 3:
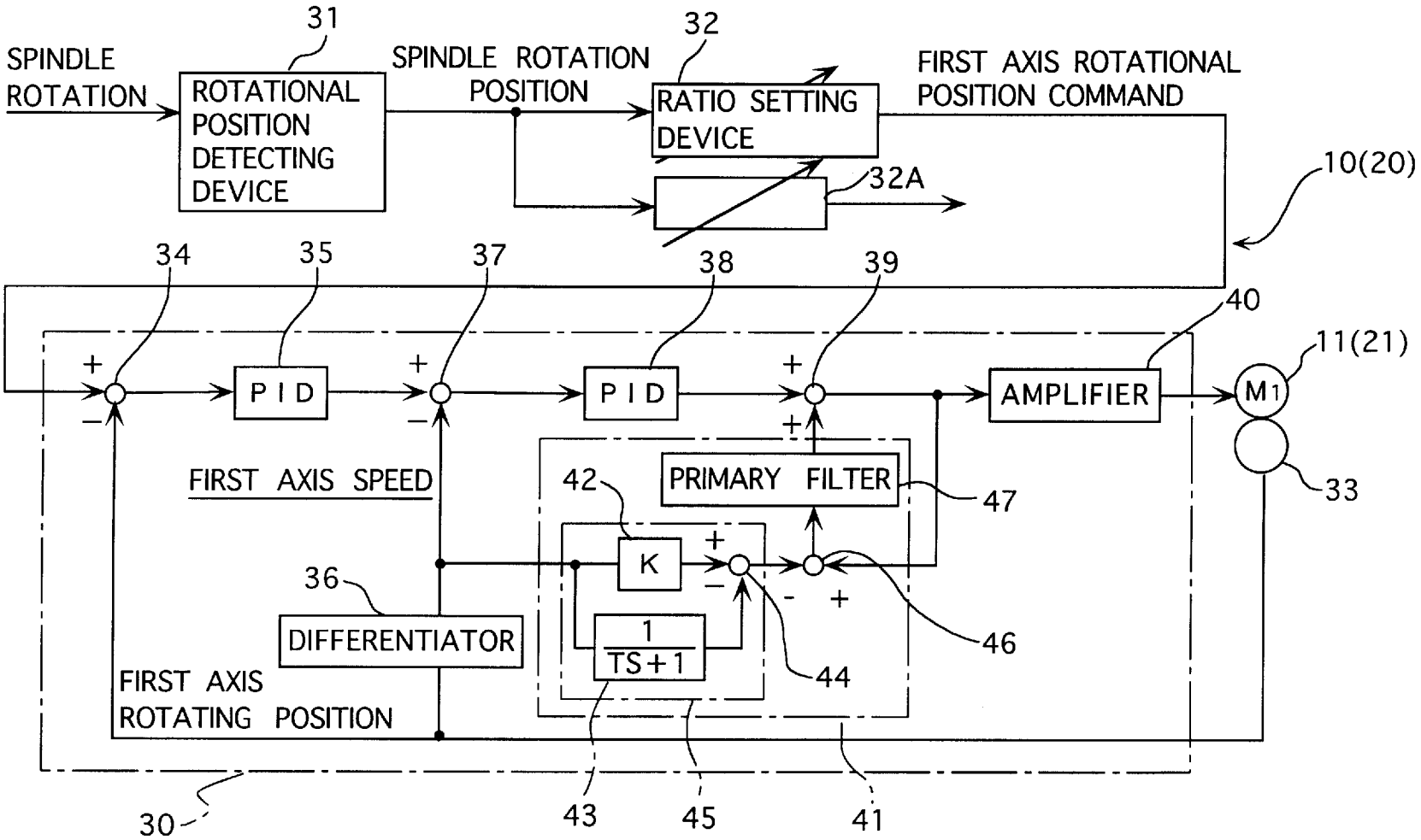
FIG. 3 is a block diagram showing a driving device showing the ink transferring rollers and the water transferring rollers according to the embodiment.
Figure 4:
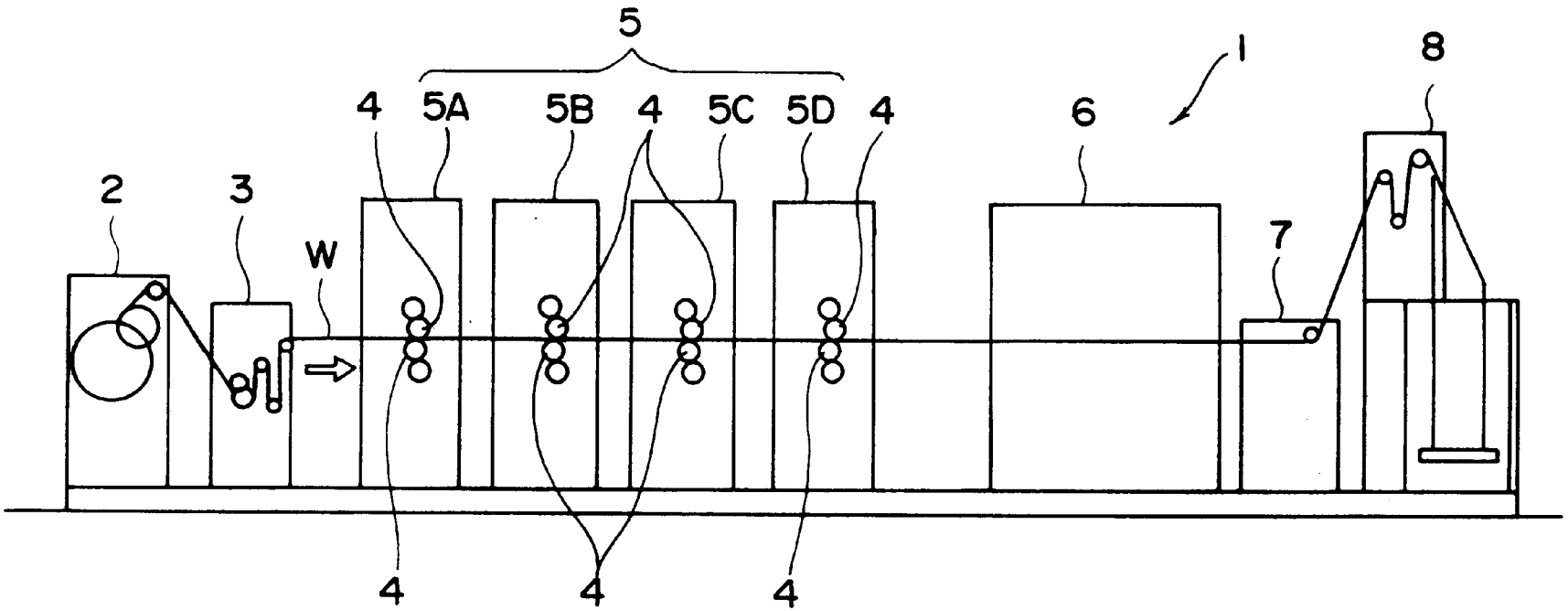
FIG. 4 PRIOR ART
FIG. 4 is an entire view showing a general offset rotary press.
Figure 5:
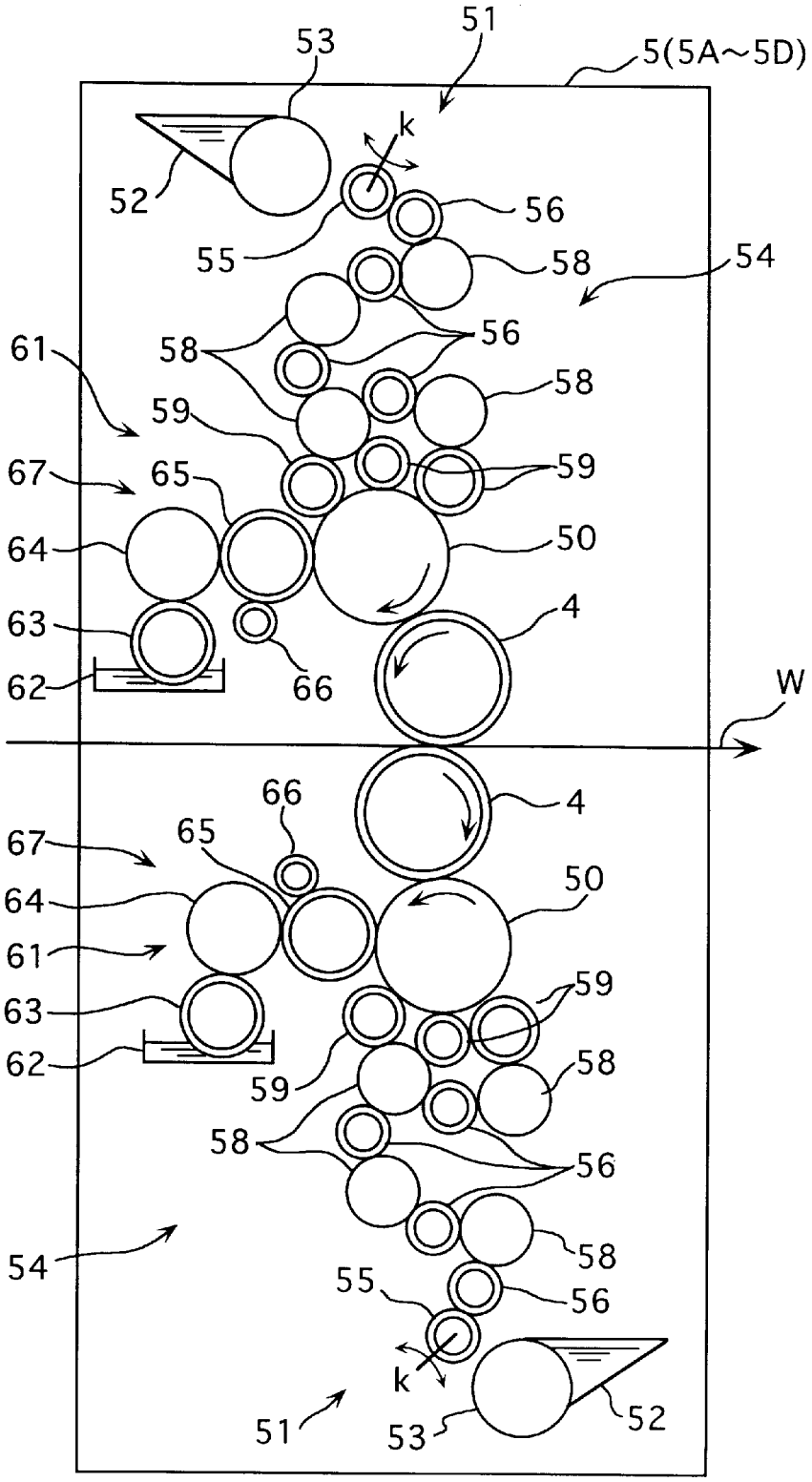
FIG. 5 PRIOR ART
FIG. 5 is an entire view showing disposition of respective rollers of printing unit of the offset rotary press.
Figure 6:
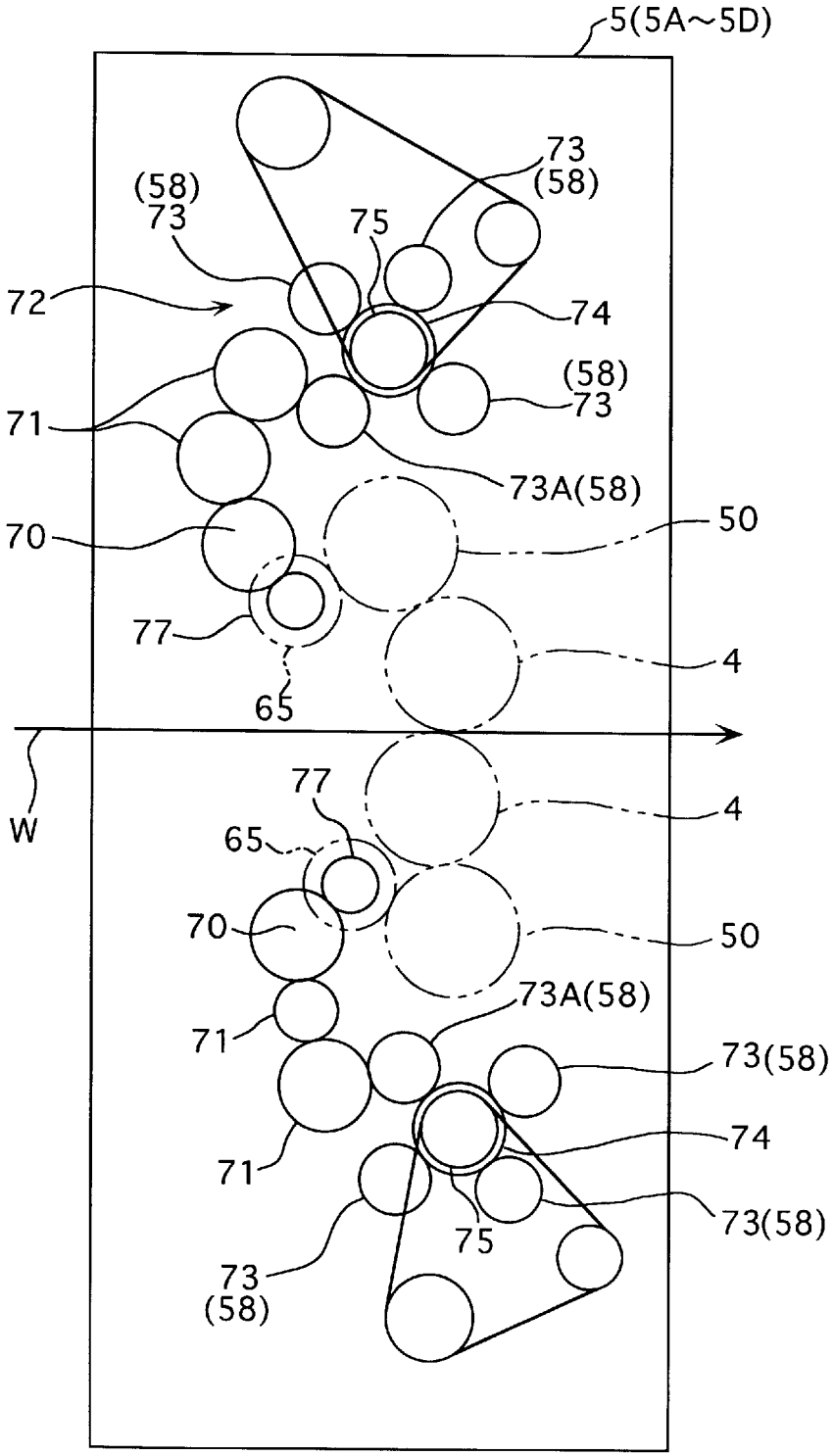
FIG. 6 PRIOR ART
FIG. 6 is an entire view showing driving system of respective rollers of conventional general printing unit.
Figure 7:
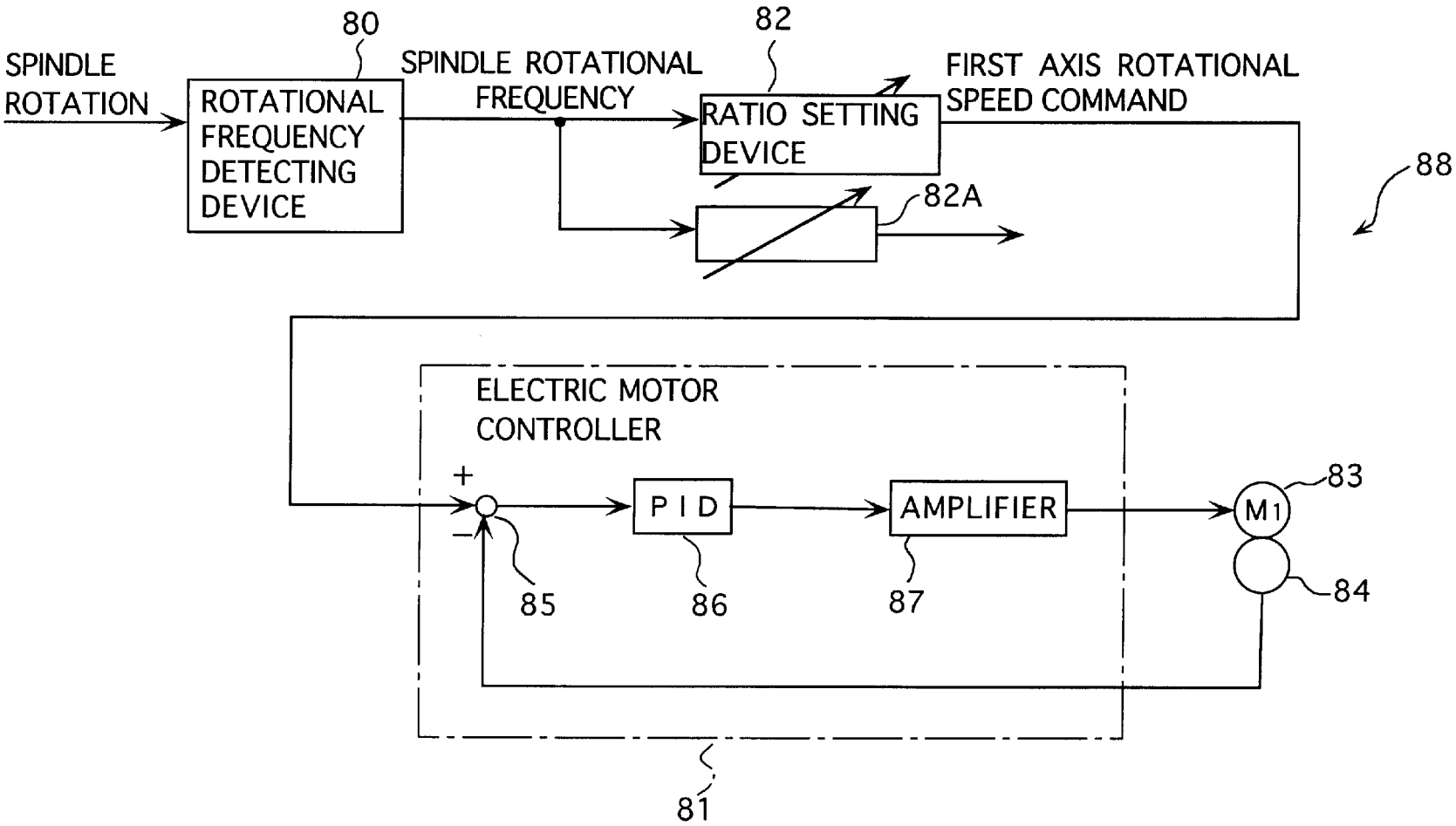
FIG. 7 PRIOR ART
FIG. 7 is a block diagram showing a driving device for electrically controlling drive of respective rollers of the general conventional printing unit with proportional operation method.

As shown in FIG. 3, the ink transferring rollers driving unit 10 and the water transferring rollers driving unit 20 respectively have the ink motor 11, the water motor 21 and a rotation controller 30 for controlling rotation of the motors 11 and 21.

The rotation controller 30 detects the rotation of the print cylinder 50 as a spindle rotational position and controls the rotation based on a rotational position command established by a ratio setting device 32 in accordance with the spindle rotational position and a rotational position of the motor 11 detected by an encoder 33 as a rotational position sensor.

The rotation controller 30 includes first arithmetic unit 34 for comparing detected position information of the ink motor 11 or the water motor 21 obtained by the encoder 33 with a position based on the rotational position command by the ratio setting device 32 to calculate difference between the positions, and a speed controller 35 for converting the outputted position command obtained from addition and subtraction by the first arithmetic unit and for outputting the position command as a speed command.

At an intermediary of the detected position information outputted by the encoder 33, a differentiator 36 for differentiating the position detected by the encoder 33 to convert into speed is disposed. A speed command from the differentiator 36 is compared with a speed command from the speed controller 35 to calculate difference between the commands by a second arithmetic unit 37.

The speed command obtained and outputted by addition or subtraction by the second arithmetic unit 37 is converted into torque by a torque controller 38. The converted value is outputted to an amplifier 40 through third arithmetic unit 39 and the amplifier 40 drives the respective motors 11 and 21.

A load torque estimator 41 for comparing and calculating the torque outputted by the torque controller 38 and a torque obtained by a pseudo differentiator 45 by further differentiating the speed differentiated by the differentiator 36 to estimate calculated value as a load torque.

The load torque estimator 41 includes the pseudo differentiator 45 for further differentiating the speed differentiated by the differentiator 36 and third arithmetic unit 46 for comparing and calculating the torque obtained by the pseudo differentiator 45 and the torque outputted by the torque controller 38.

The pseudo differentiator 45 has fourth arithmetic unit 44 for comparing a proportion element 42 and a primary delay element 43 and for outputting the difference to fifth arithmetic unit 46, so that the speed differentiated by the differentiator 36 is further differentiated.

The third arithmetic unit 39 compares the torque value outputted from the fourth arithmetic unit 44 and the torque value outputted by the torque controller 38, passes difference torque value to a primary filter 47, and adds the passed torque value to the torque value outputted by the torque controller 38 to output to the amplifier 40.

The primary filter 47 shuts frequencies exceeding predetermined frequency that is outputted by comparing the torque outputted by the torque controller 38 with the torque outputted by the pseudo differentiator 45, high-frequency for example.

In the ink transferring rollers driving unit 10 and the water transferring rollers driving unit 20, the speed of the ink motor 11 and the water motor 21 is controllable within a range of ±10% relative to the peripheral speed of the print cylinder 50 in order to improve the print quality suitably in view of viscosity and amount of ink and water.

Position control of the present invention and general speed control will be described below.

In the speed control method, when the speed signal is of input scale of ±10V (maximum speed ±2000 rpm) and resolution of 16 bit (divided in 65536 times), the speed per LSB 1 bit is approximately 0.061 rpm (at 1) based on 4000 rpm (at 65536) of full scale. In other words, the operation is only possible by approximately 0.061 rpm step. Therefore, when the input speed is, for example, 30 rpm, a speed-draw ratio is 0.061/30*100=0.2% and any value less than 0.2% is impossible. The ratio increases as the rotation speed becomes low, such as 0.305% for input speed of 20 rpm. When the speed is commanded by an analogue voltage, such problem occurs.

In contrast thereto, the above problem can be avoided according to the position control method of the present invention.

Specifically, when 20.02 degrees movement is desired for 20 degrees movement of the spindle, 1001 pulses movement is required per 1000 pulses movement of a standard in view of 20:20.02=1000:1001 (1000 pulses per 20 degrees by the encoder). Accordingly, there is no draw ratio limitation during low rotation according to resolution of analog speed command. Therefore, rotation maintaining constant draw ratio is possible even in an extremely low speed by setting a product of inputted pulse number and a predetermined ratio as a command value, though depending on resolution of position sensor.

Next, a function of the present embodiment will be described.

When ordinary printing process is conducted, the ink transferring rollers 54 and the water transferring rollers 67 are driven tracking the print cylinder 50 and the blanket cylinder 4.

For driving the ink transferring rollers 54, the ink motor 11 is driven to transmit the rotational force thereof to the first spur gear 12 and the second spur gear 14, and the ink roller driving gear 17A is driven by the third spur gear 15. The drive of the ink roller driving gear 17A is transmitted to the gears 74 and 17 to rotate the ink smoothing roller 58 and, accompanying thereto, to rotate the ink transferring rollers 54 such as the ink distributing roller 56, so that the ink is distributed on the print cylinder 50 by the ink form roller 59.

For driving the water transferring rollers 67, the water motor 21 is driven to transmit the rotational force thereof from the first timing pulley 22 to the second timing pulley 25, through the timing belt 23, and the water form roller 65 is rotated by way of the coaxial spur gear 26 and the spur gear 28, thereby distributing water on the print cylinder 50 by the water form roller 65.

When the rollers 54 and 67 are driven, the rotations of the respective driving motors 11 and 21 are synchronized with the peripheral speed of the print cylinder 50 by the rotation controller 30 of the respective driving units 10 and 20. The rotational position command established proportionally to the rotational position of the print cylinder 50 of the respective motors 11 and 21 and rotational position detected by the encoder 33 are compared and calculated, so that the value is outputted as a speed command.

On the other hand, the rotational position information from the encoder 33 is converted into speed by the differentiator 36 and is compared with the speed command value outputted to the second arithmetic unit to be calculated, to send the value to the torque controller 38.

When the ink transferring rollers 54 and the water transferring rollers 67 are separately driven independently of the print cylinder 50, the spindle rotational position command to the ratio setting device 32 is suspended and a predetermined rotational position command of the ink motor 11 and the water motor 21 is outputted to the ratio setting device 32 by a commanding means not shown.

Subsequently, respective motors 11 and 21 are driven to rotate respective rollers 54 and 67 at a predetermined speed.

According to the present embodiment, following effects can be obtained.

1) Since the ink transferring rollers 54 and the water transferring rollers 67 can be separately and variably driven respectively by the driving unit 10 and the driving unit 20 independently of the drive of the print cylinder 50, the peripheral speed of the respective rollers 54 and 67 can be kept constant relative to the peripheral speed of the print cylinder 50. Accordingly, the rotation unevenness can be prevented and doubling as a printing failure can be avoided.

2) Since the ink transferring rollers 54 and the water transferring rollers 67 can be separately and variably driven respectively by the driving unit 10 and the driving unit 20 independently of the drive of the print cylinder 50, the peripheral speeds of respective rollers 54 and 67 can be set as desired, so that the peripheral speed of the print surface can be made different from the peripheral speed of the water form roller 59. Accordingly, waterless printing suitably done by providing difference between the peripheral speeds can be easily conducted.

3) Since the peripheral speed of the ink transferring rollers 54 or the water transferring rollers 67 can be set at any speed, the peripheral speed of the print surface and the water form roller 59 can be made identical. Accordingly, the printing failure of hickey can be prevented.

4) Since the peripheral speed of the ink transferring rollers 54 or the water transferring rollers 67 can be set at any speed, the peripheral speed of the print surface and the water form roller 59 can be made identical. Accordingly, since paper dust etc. is not wound around in printing on rough paper or the like, the dust paper does not stick to a surface of the water form roller 59, thereby improving print quality in printing on rough papers. Further, since the peripheral speed of the water form roller 59 can be changed corresponding to paper quality, appropriate printing can be always conducted on papers of different paper quality, thereby providing printing machine of highly utilizablity.

5) When a malfunction occurs in, for example, the ink transferring rollers 54 or the water transferring rollers 67 while the web W is sandwiched between the blanket cylinders 4, the respective rollers 54 and 67 can be separately driven without driving print cylinder 50 etc. Accordingly, since maintenance work can be conducted without cutting the sandwiched web W, new paper feed is not required for restarting the operation and the machine can be started while the web W being sandwiched, thereby shortening machine suspension time.

6) Since the respective rollers 54 and 67 can be separately driven while stopping the rotation of the printing cylinder, ink film can be formed on the ink transferring rollers in advance. Accordingly, the water rollers and the print cylinder can be driven with the water form roller touched to feed the printing surface with dampening water before initiating printing process. And, subsequently, the ink form roller of the ink transferring rollers given with the ink film can be touched and rotated to form emulsified status immediately on the water transferring rollers 67. Therefore, spoilage amount generated in initiating the printing process can be reduced, and the web W after initiating the printing process can be used from initial stage, thereby preventing spoilage.

7) Since the respective rollers 54 and 67 can be independently driven by respective driving motors 11 and 21, the clutch conventionally required for suspending the drive of the respective rollers is not necessary, thereby simplifying the arrangement of the unit, reducing the number of components and facilitating the operation thereof.

8) Since the driving motors 11 and 21 are controlled by the rotation controller 30 for always comparing the command value and the detected value to calculate to eliminate error, the rotation unevenness can be eliminated, ink pattern and water pattern can be avoided, thereby improving print quality.

9) Since the rotation controller 30 for controlling the driving motors 11 and 21 has the load torque estimator 41 including the pseudo differentiator 45 between the differentiator 36 and the amplifier 40 and the output from the differentiator 36 is processed by the load torque estimator 41, time-delay of speed response loop can be avoided. Consequently, the responsivity to the load torque can be improved to restrain speed drop as small as possible.

10) Since the spindle rotation is detected as a position (pulse) to approximate to infinite length for conducting the position control, the speed ratio resolution limitation can be avoided in low-frequency rotation.

11) Since the filter 47 is provided to the load torque estimator 41 of the rotation controller 30 and the filter 47 shuts frequency exceeding a predetermined value such as high-frequency, minute fluctuation is not responded for each time. Accordingly, the vibration of the motors 11 and 21 can be prevented to avoid rotational unevenness, thereby improving print quality.

Incidentally, the scope of the present invention is not limited to the above-described embodiment, but includes following modification as long as the object of the present invention can be achieved.

Though the water transferring rollers 67 are driven in a different manner between the upper side and the lower side of the printing unit 5A in the aforesaid embodiment, the timing belt 23 etc. may also be used in the upper side as in the lower side. The same effect can be obtained in this arrangement.

What is claimed is:

1. A rotary press including a printing unit for printing picture on a web fed from a paper feeder, the printing unit comprising:

ink transferring rollers having a print cylinder and an ink form roller for distributing the ink drawn out from an ink fountain onto the print cylinder by an ink fountain roller;

water transferring rollers including a water form roller for distributing water drawn out from a water fountain onto the print cylinder by a water fountain roller;

ink transferring rollers driving unit for driving the ink transferring rollers independently of drive of the print cylinder mounted on the printing unit; and a water transferring rollers driving unit for driving the water transferring rollers independently of drive of the print cylinder mounted on the printing unit;

wherein the ink transferring rollers driving unit is independent of the water transferring rollers driving unit.

2. The rotary press according to claim 1, wherein the rotation speeds of the ink transferring rollers and the water transferring rollers are variable.

3. The rotary press according to claim 2, wherein driving speeds of the ink transferring rollers driving unit and the water transferring rollers driving unit for driving the ink transferring rollers and the water transferring rollers are variable.

4. The rotary press according to claim 3, wherein the ink transferring rollers driving unit and the water transferring rollers driving unit respectively include a speed-variable motor for speed-variably rotating the ink transferring rollers and the water transferring rollers and a rotation controller for controlling a rotation of the speed-variable motor based on a rotational position command corresponding to rotational position of the print cylinder, the rotation controller comprising:

first arithmetic unit for comparing a detected position information by a rotational position sensor of the speed-variable motor and a position based on the rotational position command to calculate difference therebetween;

a speed controller for converting a position command calculated and outputted by the first arithmetic unit to output as a speed command;

a differentiator provided at an intermediary of the detected position information for differentiating the position information detected by the rotational position sensor to convert into speed;

second arithmetic unit for comparing the speed command from the speed controller and the speed from the differentiator to calculate the difference therebetween;

a torque controller for converting the speed command calculated and outputted by the second arithmetic unit into a torque command; and an amplifier for driving the speed-variable motor based on the torque command from the torque controller.

5. The rotary press according to claim 4, further comprising a load torque estimator provided between the differentiator and the amplifier for comparing and calculating the torque outputted by the torque controller and the torque obtained by further differentiating the speed differentiated by the differentiator by a pseudo differentiator, wherein third arithmetic unit for adding the torque to the torque controller to output to the amplifier is connected the load torque estimator.

6. The rotary press according to claim 5, wherein the load torque estimator includes a filter for shutting frequency of exceeding a predetermined frequency outputted by comparing and calculating the torque outputted by the torque controller and the torque outputted by the pseudo differentiator.

* * * * *

US006298779C1

(12) EX PARTE REEXAMINATION CERTIFICATE (5002nd)

United States Patent

Gotanda et al.

(10) Number: US 6,298,779 C1

(45) Certificate Issued: Oct. 19, 2004

(54) ROTARY PRESS

(75) Inventors: Takashi Gotanda, Yamato (JP); Takafumi Kawaguchi, Zama (JP)

(73) Assignee: Toshiba Kikai kabushiki Kaisha, Tokyo (JP)

Reexamination Request:
No. 90/006,262, Apr. 4, 2002

Reexamination Certificate for:

| | |
|---|---|
| Patent No.: | **6,298,779** |
| Issued: | **Oct. 9, 2001** |
| Appl. No.: | **09/435,345** |
| Filed: | **Nov. 8, 1999** |

(30) Foreign Application Priority Data

Nov. 11, 1998 (JP) ..... 10-320619

(51) Int. Cl.[7] ..... D41F 33/00; B41L 23/00

(52) U.S. Cl. ..... 101/350.1; 101/148

(58) Field of Search ..... 101/147, 148, 101/350.1, 350.2, 363, 364, 365, 366

(56) References Cited

U.S. PATENT DOCUMENTS 4,157,682 A * 6/1979 Mabrouk et al. ..... 101/148
4,619,198 A * 10/1986 Moll ..... 101/148
5,377,589 A 1/1995 Krüger et al. ..... 101/248
6,338,298 B2 1/2002 Schneider et al. ..... 101/179
6,408,748 B1 * 6/2002 Hajek et al. ..... 101/177

FOREIGN PATENT DOCUMENTS

DE 195 20 841 A1 12/1996
EP 0 699 524 A2 3/1996

OTHER PUBLICATIONS

Joachim Sonnenschein, Direct–Drive Technology, VDD Seminar Series, 1995, pp. 10–11, with translation.

* cited by examiner

*Primary Examiner*—Daniel J. Colilla

(57) ABSTRACT

In a rotary press, ink transferring rollers and water transferring rollers provided in printing units are capable of separately and speed-variably controlled respectively by ink transferring rollers driving unit and water transferring driving unit independently of drive of print cylinder of the printing unit. Accordingly, spoilage can be avoided and printing failure such as doubling and hickey can be prevented, thereby improving print quality.

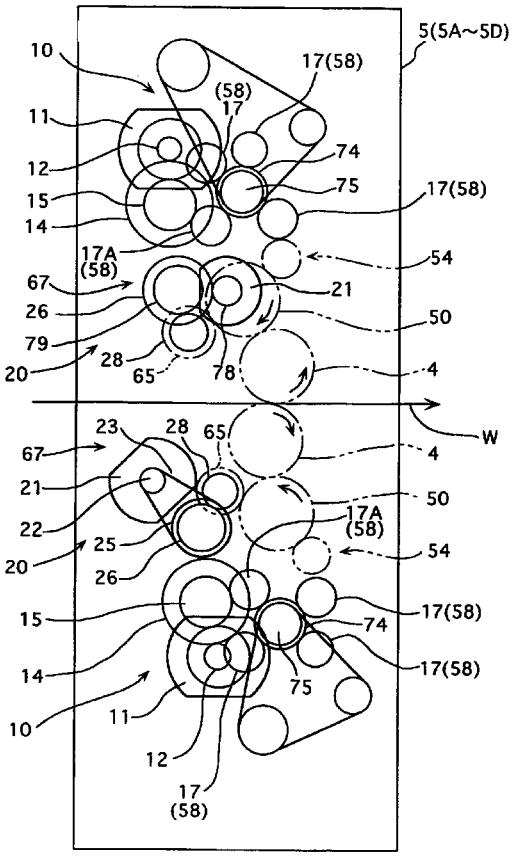

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5–6 is confirmed.

* * * * *